US006294975B1

(12) United States Patent
Chen

(10) Patent No.: US 6,294,975 B1
(45) **Date of Patent: *Sep. 25, 2001**

(54) TRANSFORMER BOBBIN WITH HIPOT-PROTECT STRUCTURE

(75) Inventor: James Chien-Chung Chen, Taipei (TW)

(73) Assignee: Atech Technology Co., Ltd., Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/201,861

(22) Filed: Dec. 1, 1998

(51) Int. Cl.[7] ..... H01F 27/30
(52) U.S. Cl. ..... 336/198; 336/65
(58) Field of Search ..... 336/198, 208, 336/192; D13/118

(56) References Cited

U.S. PATENT DOCUMENTS

D. 334,913 * 4/1993 Sato et al. ..... D13/118
D. 385,848 * 11/1997 Sato et al. ..... 336/198
5,157,368 * 10/1992 Okano et al. ..... 336/198
5,760,670 * 6/1998 Yen et al. ..... 336/198

* cited by examiner

*Primary Examiner*—Lincoln Donovan
*Assistant Examiner*—Taylor T. Nguylu
(74) *Attorney, Agent, or Firm*—Dougherty & Troxell

(57) ABSTRACT

Disclosed is a transformer bobbin with hipot-protect structure. The bobbin is integrally formed from plastic material through injection molding and includes a central shaft portion and an outer frame portion at two ends of the central shaft portion. When the bobbin is formed during molding, the outer frame portion is extended from one or two lateral outer ends thereof for a length and therefore forms one or two extended portions on the bobbin. Upright rib or ribs may be additionally provided on top surface of the extended portion. The extended portion provide increased creepage distance between pins connected to outer end surfaces of the bobbin and the core of the transformer to effectively prevent hipot from transiting from pins at one end to pins at the other end by crossing over the core directly.

1 Claim, 5 Drawing Sheets

TRANSFORMER BOBBIN WITH HIPOT-PROTECT STRUCTURE

BACKGROUND OF THE INVENTION

The present invention relates to a transformer bobbin with hipot-protect structure, and more particularly to a transformer bobbin having portion or portions extended from one or two pin-connection sides to provide increased creepage distance on the extended bobbin between a pin connected thereto and a core of the transformer for preventing a hipot from directly crossing over the core between pins at two sides of the bobbin and thereby complying with relevant safety code.

Transformers are required components in electronic circuits. Since circuit boards used in the existing electronic products are very thin, small and light in volume, transformers used for constructing the circuit boards also require largely reduced size. However, all transformers mainly structurally include a bobbin, multiple pins, a core, and a winding. While transformers of different specifications provide different voltage-change function, they all have to comply with relevant safety codes specifying safe and protective requirements thereof. Among the safety codes, there is one particularly concerning "creepagedistance". The creepage distance may be 1.6 mm, 2.5 mm or other length, depending on grades, such as A or B grade, specified in the code. The purpose of creepage distance is to define a safety distance between two metal components so as to prevent hipot occurred at lightning, for example, from directly crossing over a conductive metal component to another metal component and resulting in damages, such as short circuit, to other components in the same circuit. Such safety distance must exist between the winding and the core, the pins and the second winding, or the pins and core. For the existing transformers of different specifications, there are different isolating means respectively provided to achieve the required safety distances between different components. In the present invention, a hipot-protect structure is provided on the bobbin of a transformer to achieve an increased creepage distance between the pins and the core to comply with relevant safety code.

SUMMARY OF THE INVENTION

A primary object of the present invention is to provide a transformer bobbin with hipot-protect structure. The bobbin according to the present invention is extended from one or two pin-connection sides to form extended portion or portions, so that the creepage distance from pins connected to the bobbin to the core of the transformer along the extended portion of the bobbin is increased to comply with relevant safety code and sufficiently isolate a hipot from the core.

Another object of the present invention is to provide a transformer bobbin with hipot-protect structure. The hipot-protect structure includes extended portion or portions formed at one or two sides of the bobbin when the bobbin is formed through injection molding. The extended portion of portions may have different shapes so long as they provide a creepage distance no shorter than that required by the safety code.

DETAILED DESCRIPTION OF THE PREFERRED EMBODIMENTS

Following is a detailed description of the structure and features of the present invention with reference to the accompanying drawings.

Figure 1:
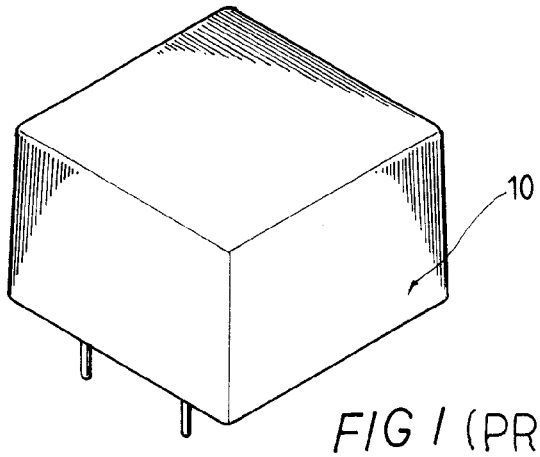
FIG 1 (PRIOR ART)
FIG. 1 is a perspective of a first type of conventional transformer.
Figure 2:
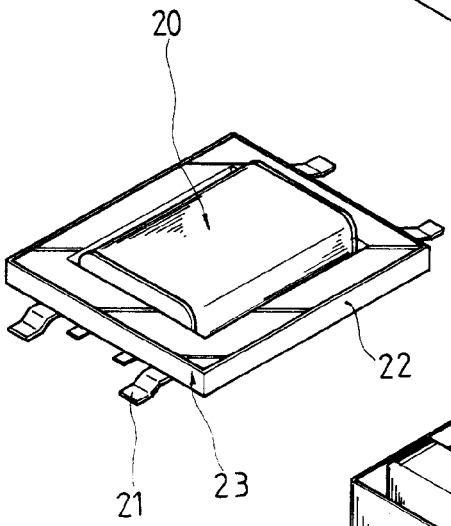
FIG 2 (PRIOR ART)
FIG. 2 is a perspective of a second type of conventional transformer.
Figure 3:
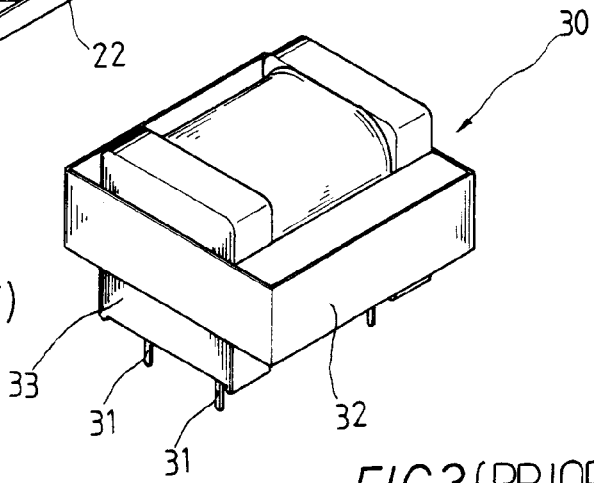
FIG3 (PRIOR ART)
FIG. 3 is a perspective of a third type of conventional transformer.
Figure 4:
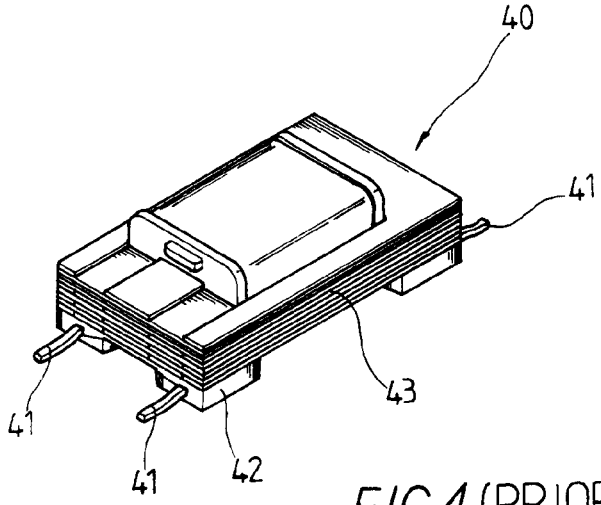
FIG 4 (PRIOR ART)
FIG. 4 is a perspective of a fourth type of conventional transformer.

FIG. 1 shows a first conventional transformer 10 that is completely enclosed in a plastic casing which provides an excellent isolating effect to the transformer 10 but makes the transformer 10 big in volume. FIG. 2 illustrates a second conventional transformer 20 that has smaller volume than the transformer 10 but has a shortened distance between the pins 21 and the core 22 of the transformer 20 and necessitates additional isolation process, such as applying layers of adhesive tape over side surfaces 23 of the core 22. FIG. 3 shows a third conventional transformer 30 which is also well isolated from hipot because the bobbin 33 thereof provides sufficient creepage distance between the pins 31 and the core 32. FIG. 4 shows a fourth conventional transformer 40, the pins 41 of which are connected to two lateral side surfaces of the bobbin 42 and the core 43 thereof is inserted through a top of the bobbin 42. The trans former 40 has a specially designed low profile to minimize its height projected from a PC board. On the other hand, the distance between the pins 41 and the core 43 is too close to achieve a hipot-protect effect. That is, a hipot could transit from pins 41 at one side of the bobbin 42 having high tension to another pins 41 at the other side of the bobbin 42 having low tension by directly crossing over the core 43 closely adjacent to the pins 41 at the high-tension side. This will cause damage to other electronic circuits. In consideration of hipot-protect and other safety requirements, it is necessary to improve the conventional transformers to eliminate their existing drawbacks.

Figure 5:
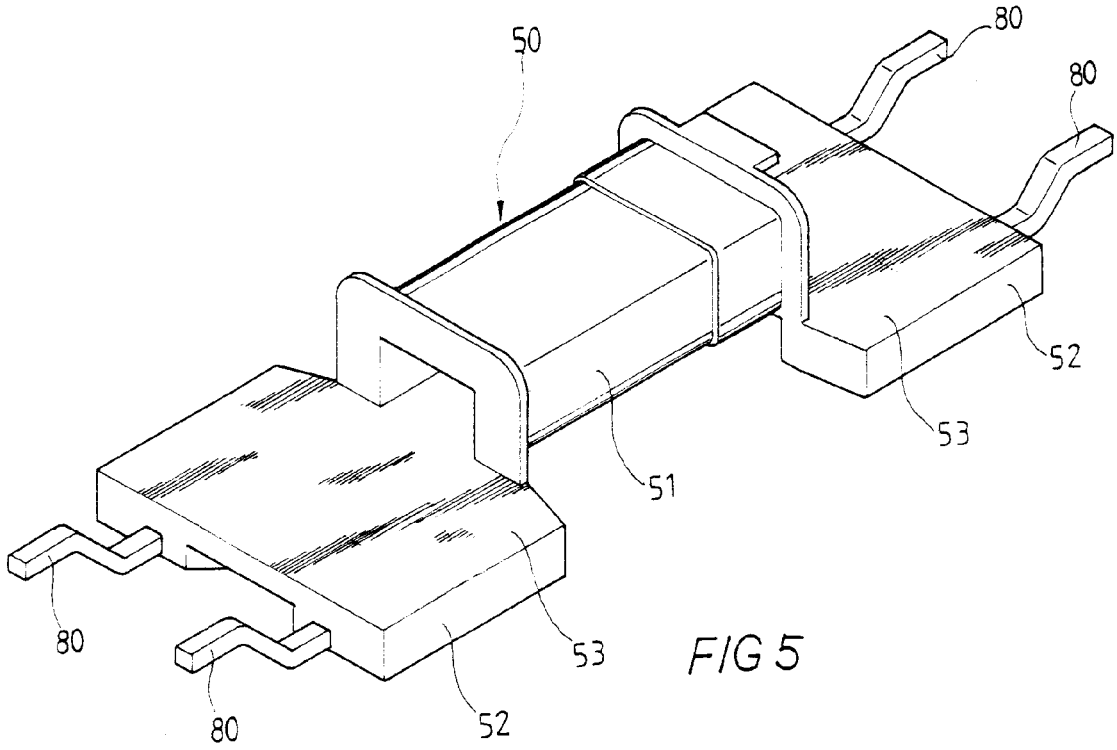
FIG. 5 is a perspective of a transformer bobbin according to a first embodiment of the present invention.
Figure 6:
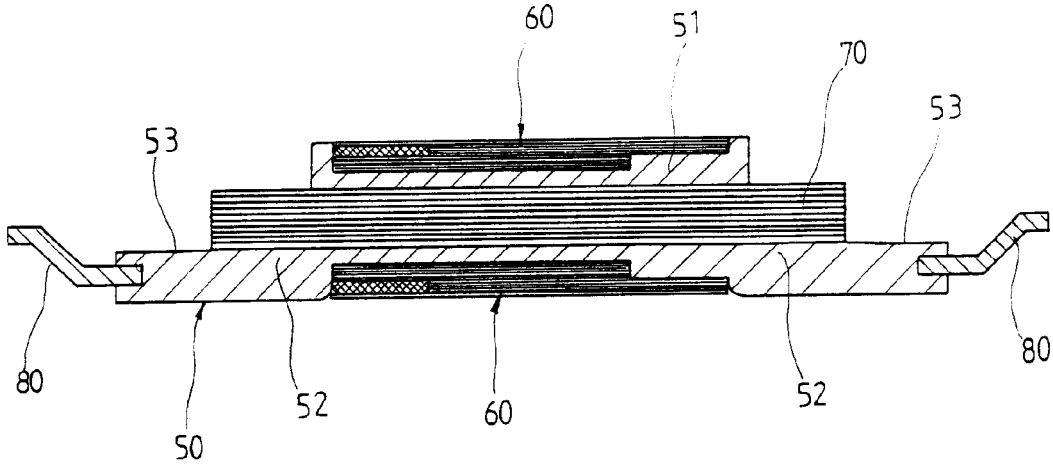
FIG. 6 is a side sectional view of the bobbin of FIG. 5.
Figure 7:
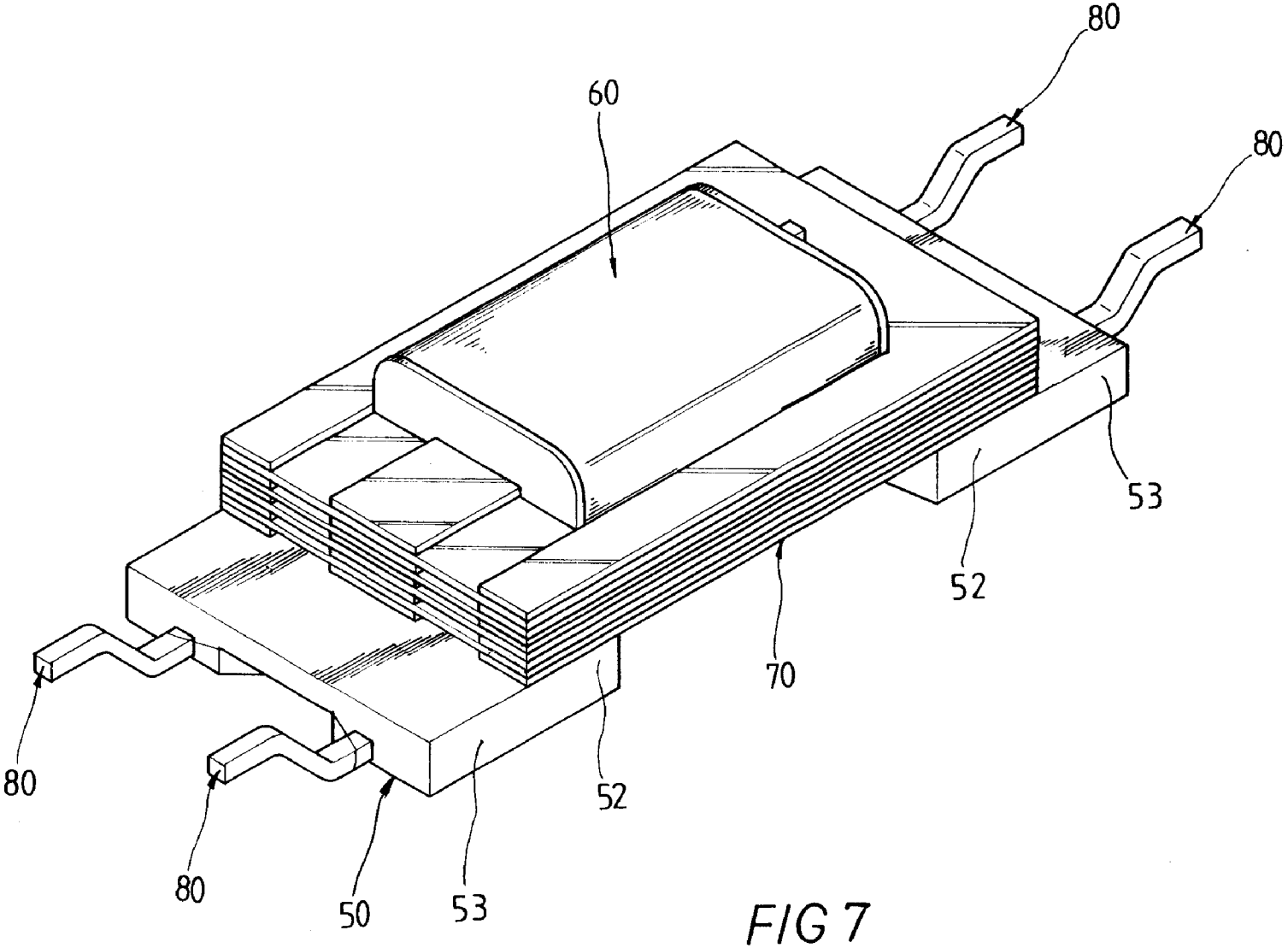
FIG. 7 is a perspective of a transformer using the bobbin of FIG. 5.

Please refer to FIGS. 5, 6 and 7 at the same time. FIG. 5 is a perspective of a bobbin 50 according to a first embodiment of the present invention. The bobbin 50 together with a winding 60, a core 70, and multiple pins 80 form a complete transformer. The bobbin 50 is made of plastic material and integrally formed through injection molding to include a central shaft portion 51 for primary and secondary windings 60 to wind therearound and outer frame portions 52 projected from two lateral ends of the central shaft portion 51 for supporting the core 70 that is inserted through the central shaft portion 51. The central shaft portion 51 and the outer frame portion 52 are structurally similar to those of conventional bobbins, except that the outer frame portion 52 of the bobbin 50 extends outward from two lateral ends thereof to form two extended portions 53. The extended portions 53 are formed by extending two lateral ends of the same thickness of the bobbin 50 for a predetermined length when the bobbin 50 is integrally molded. Pins 80 are then connected to two lateral end surfaces of the extended portions 53. For the pins 80 to firmly connect to the extended portions 53, the extended portions 53 themselves must have suitable thickness. Usually, the extended portions 53 have a thickness the same as that of the outer frame portion 52. When the extended portion 53 each provides a sufficient creepage distance between the core 70 and the adjacent pins 80, for example 2.5 mm, the transformer could comply with the relevant safety code and be effectively protected against possible hipot which transits from pins 80 at one side to pins 80 at opposite side via the core 70. And, no other damage to the circuits and loss will be caused. Since the creepage distance means the length of a line creeping along an outer surface of the extended portion 53 from an inner end of the pin 80 to a lateral side surface of the core 70 adjacent to the pin 80, the creepage distance is actually slightly larger than a length of the extended portion 53 as can be seen from FIG. 6.

Figure 8:
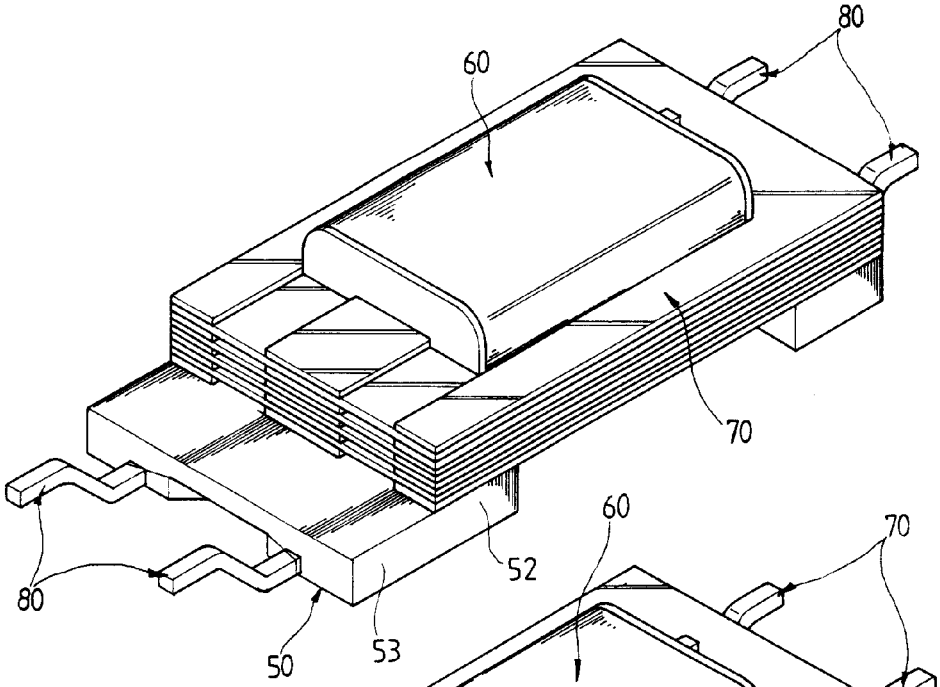
FIG. 8 is a perspective of a transformer using a bobbin according to a second embodiment of the present invention.

FIG. 8 shows a bobbin 50 similar to that shown in FIGS. 5, 6 and 7 but with the extended portion 53 formed at only one lateral side of the bobbin 50. This one single extended portion 53 may still provide hipot-protect function to prevent a hipot from crossing over the core 70, so long as the extended portion 53 provides sufficient creepage distance between the core 70 and the pins 80 adjacent to it.

It is necessary to consider some possible problems in the process of injection molding a bobbin 50 having integrally formed extended portion or portions 53 and therefore prolonged body and different thickness at different areas. Such possible problems include, for example, even distribution of plastic material in the molds, shrinkage of plastic material after molding, strength of molded product, etc. To overcome the above-mentioned possible problems, some modifications can be made to the extended portions 53 in their shapes to facilitate the manufacture of bobbin 50.

Figure 9:
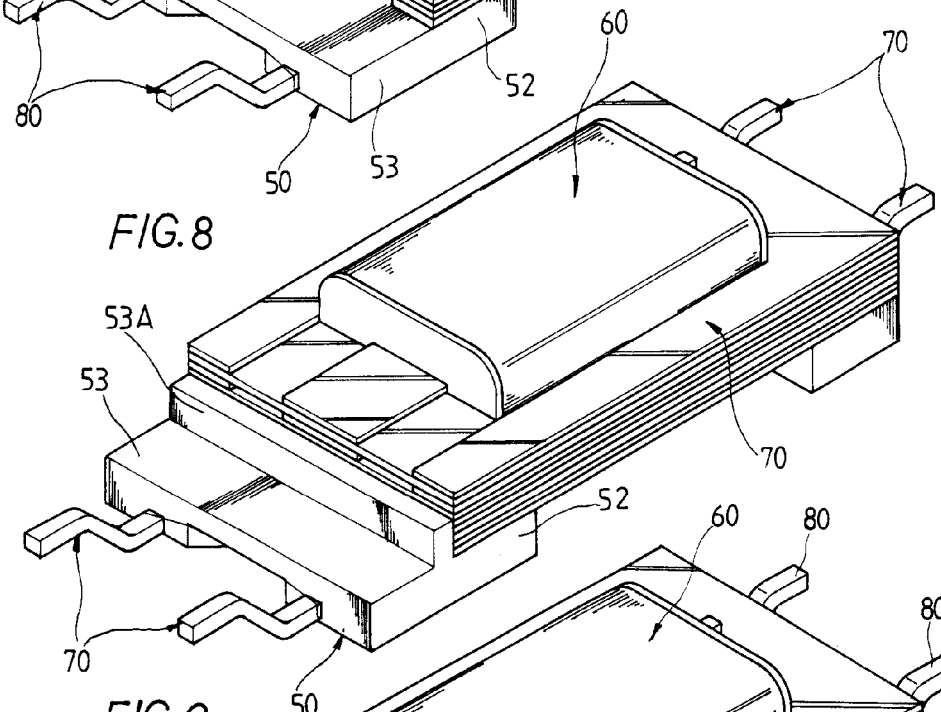
FIG. 9 is a perspective of a transformer using a bobbin according to a third embodiment of the present invention.
Figure 10:
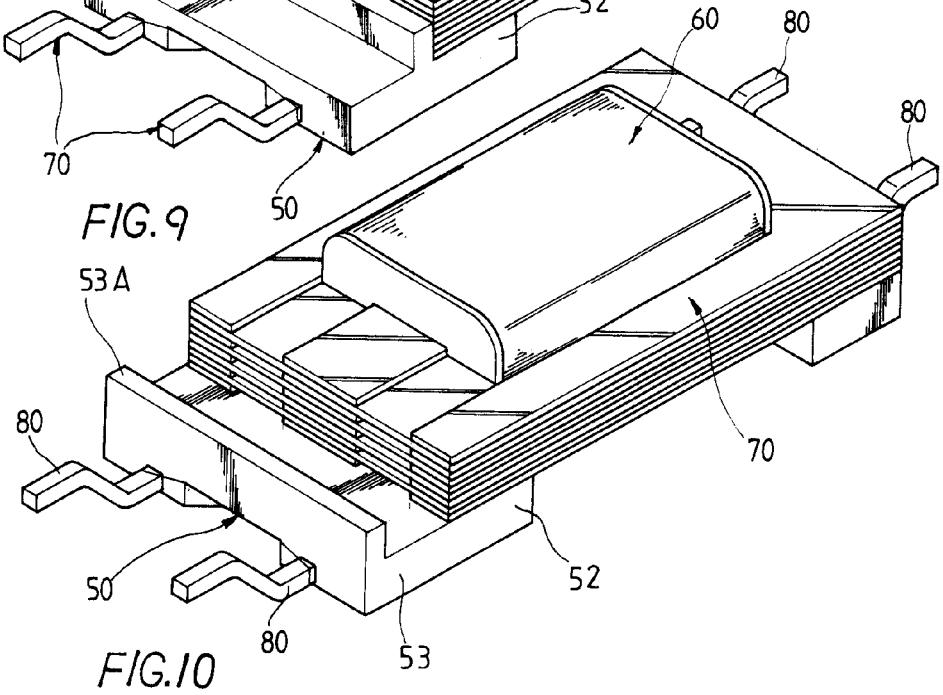
FIG. 10 is a perspective of a transformer using a bobbin according to a fourth embodiment of the present invention.

As shown in FIGS. 9 and 10, the extended portion 53 is formed at only one lateral end of the bobbin 50 like that in FIG. 8 but is modified in shape. That is, a long rib 53A is additionally provided on a plane top surface of the extended portion 53. It is preferable the rib 53A is upright from the top surface of the extended portion 53 and horizontally extends in a direction parallel to the lateral side surface of the core 70. The rib 53A may be located adjacent to the outer frame portion 52 as shown in FIG. 9 or at an outer end of the extended portion 53 as shown in FIG. 10. The long rib 53A on the extended portion 53 is provided in consideration of actual need in the manufacturing process, it changes the shape of the bobbin 50 but serves as a wall to create increased creepage distance between the pins 80 and the core 70 and therefore enhanced insulation effect. On the other hand, since the provision of long rib 53A increases the creepage distance, the length of the extended portion 53 projecting from the outer frame portion 52 can be correspondingly reduced to facilitate the injection molding of the whole bobbin 50.

Figure 11:
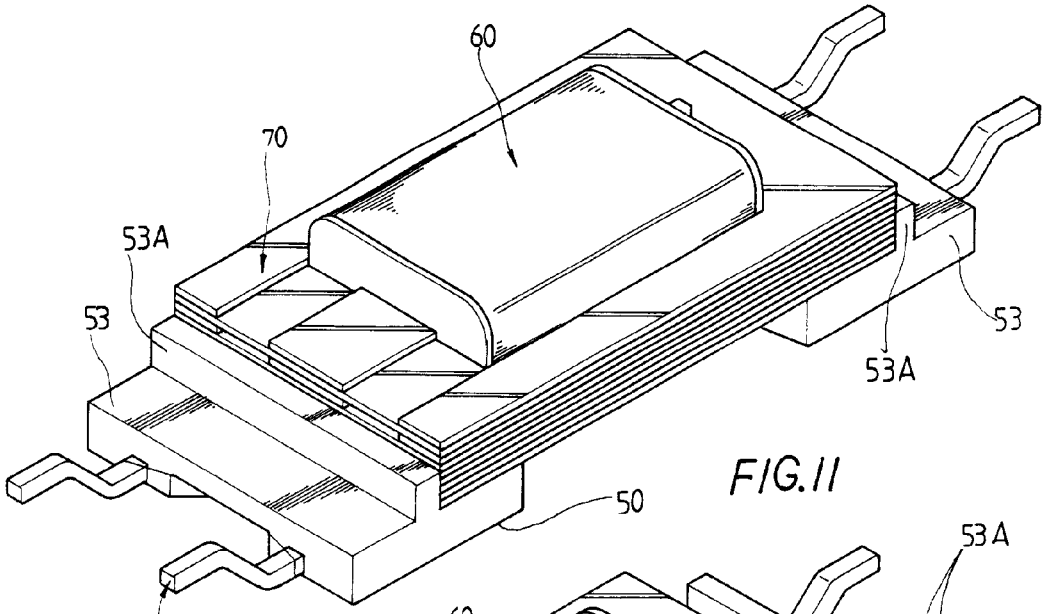
FIG. 11 is a perspective of a transformer using a bobbin according to a fifth embodiment of the present invention.
Figure 12:
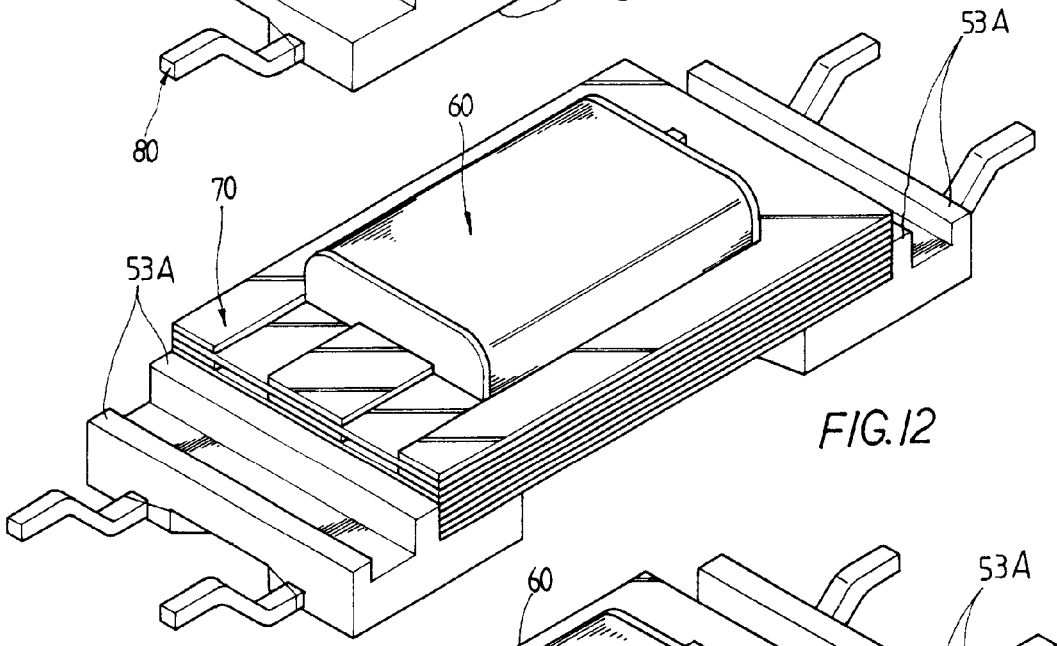
FIG. 12 is a perspective of a transformer using a bobbin according to a sixth embodiment of the present invention.
Figure 13:
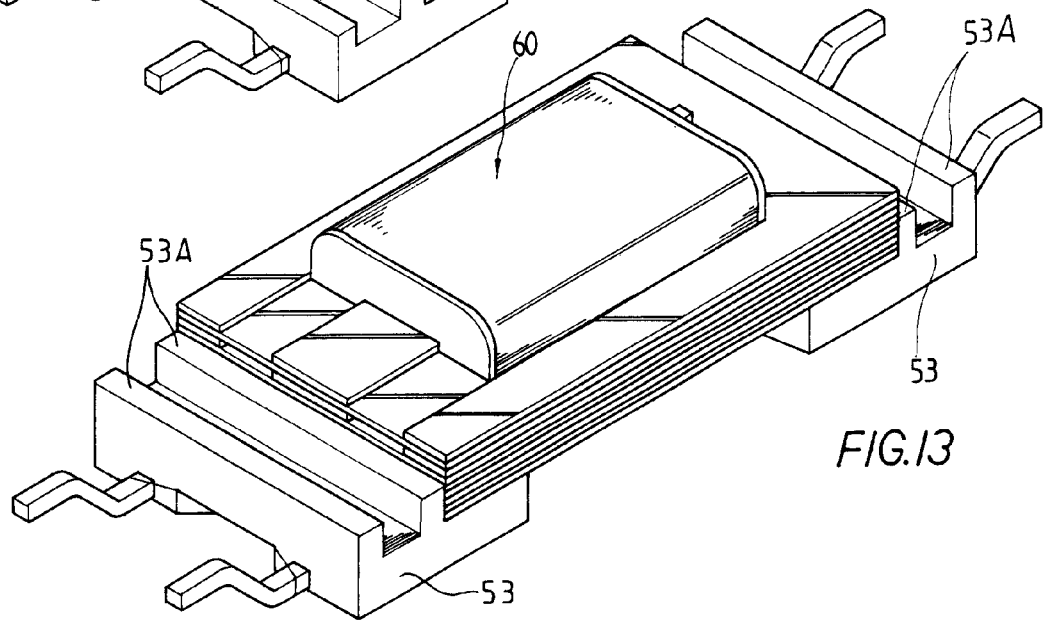
FIG. 13 is a perspective of a transformer using a bobbin according to a seventh embodiment of the present invention.

The extended portion 53 and the long rib 53A may also be symmetrically formed at two lateral ends of the bobbin 50, as shown in FIGS. 11 to 13 to provide even better hipot-protect insulating effect and pass extremely strict safety code. There can be only one rib 53A on either extended portion 53 as shown in FIG. 11. Or, two parallel ribs 53A having different heights may be provided on either extended portion 53 as shown in FIG. 12. Or, two parallel ribs 53A having the same height may be provided on either extended portion 53 as shown in FIG. 13.

It is understood that the provision of different numbers of ribs 53A on the extended portion(s) 53 is only one of many different ways to change the shape of the extended portion(s) 53. Any other changes may also be made to the extended portion(s) 53 so long as such changes could increase the creepage distance between the pins and the core and facilitate the injection molding of the bobbin.

What is claimed is:

1. A transformer bobbin with hipot-protect structure, said bobbin together with windings, a core, and multiple pins forming a basic transformer, said bobbin being made of plastic material and integrally formed by injection molding to include a central shaft portion for primary and secondary windings to wind therearound and outer frame portions including two lateral ends extending outwardly from said central shaft portion for supporting said core that is inserted through said central shaft portion and said extended portions having the same thickness as said outer frame portions and sufficient thickness to and encompassing an end of said pins, said pins being connected to said two outer lateral ends; said hipot-protect structure comprising two extended portions one of which extends from each of said two lateral ends of said outer frame portions of said bobbin for a predetermined length to provide a sufficient creepage distance to prevent hipot from transiting from said pins at one lateral end of said bobbin to said pins at the other lateral end thereof and wherein said extended portions each include a planar top surface and a pair of parallel upright ribs on said top surface of said extended portion to form a generally U-shaped channel between said ribs and wherein said ribs extend in a direction parallel to said lateral outer end of said bobbin.

* * * * *